United States Patent [19]

Acciacca et al.

[11] Patent Number: 4,976,478

[45] Date of Patent: Dec. 11, 1990

[54] RELEASE FOR CLOSURE PANEL PULL DOWN MECHANISM

[75] Inventors: Allan C. Acciacca, Mt. Clemens; Bela Gergoe, Birmingham, both of Mich.

[73] Assignee: General Motors Corporation, Detroit, Mich.

[21] Appl. No.: 445,327

[22] Filed: Dec. 4, 1989

[51] Int. Cl.[5] ..... E05B 65/19

[52] U.S. Cl. ..... 292/201; 292/341.16; 292/16.43; 292/216

[58] Field of Search ..... 292/341.16, 216, 201, 292/DIG. 43, DIG. 4, DIG. 62

[56] References Cited

U.S. PATENT DOCUMENTS

| | | | |
|---|---|---|---|
| 2,729,486 | 1/1956 | Evans | 292/254 X |
| 2,896,990 | 7/1959 | Garvey | 292/341.16 X |
| 2,903,288 | 9/1959 | Joachim et al. | 292/341.16 |
| 2,916,319 | 12/1959 | DuBois | 292/341.16 |
| 2,943,880 | 7/1960 | Joachim | 292/201 |
| 2,994,550 | 8/1961 | White | 292/341.16 |
| 3,312,491 | 4/1967 | Peters | 292/201 |
| 3,403,934 | 10/1968 | Butts | 292/341.16 |
| 3,835,678 | 9/1974 | Meyer et al. | 292/341.16 |
| 4,652,027 | 3/1987 | Quantz | 292/DIG. 43 X |
| 4,671,548 | 6/1987 | Haberle et al. | 292/216 |
| 4,746,153 | 5/1988 | Compeau et al. | 292/216 |
| 4,869,537 | 9/1987 | Compeau et al. | 292/DIG. 25 X |
| 4,892,340 | 1/1990 | Matumoto | 292/216 X |

FOREIGN PATENT DOCUMENTS

3333746A1 of 1985 Fed. Rep. of Germany .

*Primary Examiner*—Eric K. Nicholson

*Attorney, Agent, or Firm*—Charles E. Leahy

[57] ABSTRACT

A vehicle body compartment is closed by a closure panel movable between an open position and a closed position. A latch assembly has a latch bolt spring biased to an unlatched position and normally maintained in the latched position by a detent lever. A pull down mechanism includes a housing mounted on a vehicle body panel and mounting the latch assembly on the housing body for movement by a motorized vertically reciprocating drive unit between an extended position and a retracted position. When the closure panel is moved toward the closed position, a striker carried by the closure panel engages with the extended latch assembly to interconnect the closure panel with the latch assembly. The drive unit is energized and retracts the latch assembly, thereby pulling the closure panel to its fully closed position. To open the closure panel, the operator energizes the drive unit to move the latch assembly from the retracted position to the extended position. A cam lever associated with the latch assembly engages with a cam fixedly mounted on the housing during extending movement of the latch assembly by the drive unit to cam the detent lever to the position releasing the latch bolt, thereby freeing the closure panel for movement to the open position.

2 Claims, 4 Drawing Sheets

RELEASE FOR CLOSURE PANEL PULL DOWN MECHANISM

The invention relates to a pull down mechanism for closing a vehicle closure panel and more particularly provides an improved cam operated release for the latch.

BACKGROUND OF THE INVENTION

It is well known in the prior art to provide a vehicle body closure panel, such as a rear deck lid, which is hingedly mounted and spring loaded for movement to an open position. A latch assembly is mounted on the panel and has a latch bolt which is spring biased to an unlatched position. When the deck lid is slammed to a closed position, the latch bolt latches with a striker mounted on the vehicle body to latch the panel in the closed position. The latch assembly traditionally includes a detent lever which holds the latch bolt in the latched position and a key cylinder for releasing the detent lever from the latch bolt so that the latch bolt is spring biased to the unlatched position releasing the panel for movement to its open position.

It is also well known in the prior art to provide a motorized pull down mechanism for pulling the panel to the fully closed position, thereby eliminating the need for the user to slam the panel. The pull down mechanism traditionally includes a housing mounted on the vehicle body and having the striker mounted thereon by a motorized vertically movable drive unit for movement between an extended position and a retracted position. When the striker is extended, closing movement of the panel causes the latch bolt to engage the striker so that the panel and striker are latched together. This engagement closes a switch and energizes the motorized drive unit to retract the striker and thereby pull the panel to the fully closed position. When the panel is returned to the open position by operating the key or by remote electrical operation from inside the passenger compartment, the motorized drive unit moves the striker from the retracted position to the extended position in readiness for subsequent engagement by the latch bolt upon closing movement of the panel.

U.S. Pat. No. 4,746,153 by David E. Compeau et al, assigned to the assignee of this invention, provided an improvement in the aforedescribed pull down unit in which a cam mechanism was provided in association with the latch assembly to cam the detent lever to the position releasing the latch bolt in response to initial upward opening movement of the latch assembly by the motorized striker so that the latch bolt would be spring biased to unlatch from the striker and thereby free the closure panel for spring loaded movement to the open position.

The present invention provides a further improvement in the release mechanism of U.S. Pat. No. 4,746,153 and has the latch assembly mounted on the motorized drive unit and a cam lever projecting from the latch assembly to engage a cam fixed mounted on the body panel to thereby release the detent lever from the latch bolt upon movement of the latch assembly in the extended direction

SUMMARY OF THE INVENTION

A vehicle body compartment is closed by a closure panel movable between an open position and a closed position. A latch assembly has a latch bolt spring biased to an unlatched position and normally maintained in the latched position by a detent lever. A pull down mechanism includes a housing mounted on a vehicle body panel and mounting the latch assembly on the housing body for movement by a motorized vertically reciprocating drive unit between an extended position and a retracted position. When the closure panel is moved toward the closed position, a striker carried by the closure panel engages with the extended latch assembly to interconnect the closure panel with the latch assembly. The drive unit is energized and retracts the latch assembly, thereby pulling the closure panel to its fully closed position. To open the closure panel, the operator energizes the drive unit to move the latch assembly from the retracted position to the extended position. A cam lever associated with the latch assembly engages with a cam fixedly mounted on the housing during extending movement of the latch assembly by the drive unit to cam the detent lever to the position releasing the latch bolt, thereby freeing the closure panel for movement to the open position.

BRIEF DESCRIPTION OF THE DRAWINGS

These and other objects, features and advantages of the invention will become apparent upon consideration of the specification and the appended drawings in which.

DESCRIPTION OF THE PREFERRED EMBODIMENT

Figure 1:
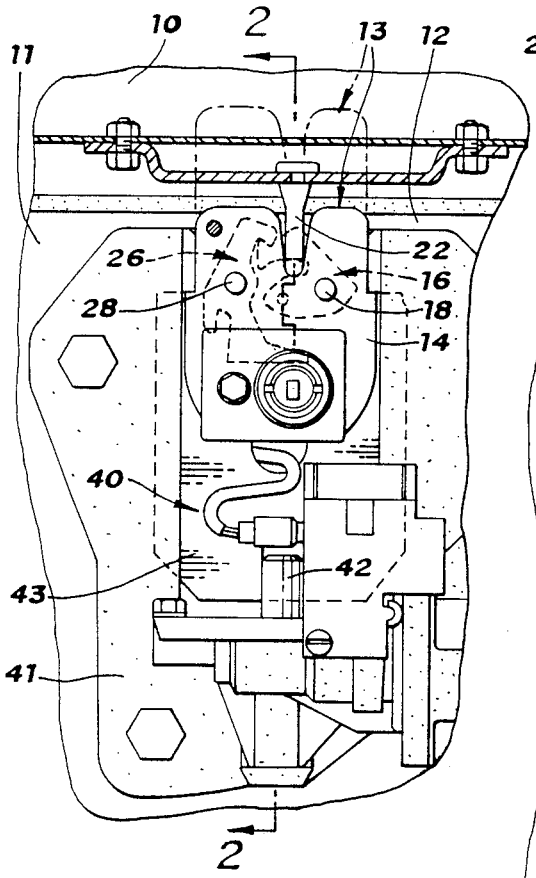
FIG. 1 is an elevation view of the compartment panel latch and the pull down mechanism, shown in the position in which the latch assembly has been engaged by the striker and the latch assembly has been retracted downwardly to completely close the closure panel 10.

Referring to FIG. 1, a deck lid closure panel of a vehicle body is indicated at 10. The closure panel 10 is hingedly mounted on the vehicle body for movement between open and closed positions with respect to a vehicle compartment. The closure panel 10 is spring loaded for movement to the open position. FIG. 1 also shows a vehicle body panel 11 which defines the compartment opening 12 which is selectively closed by the closure panel 10.

Figure 3:
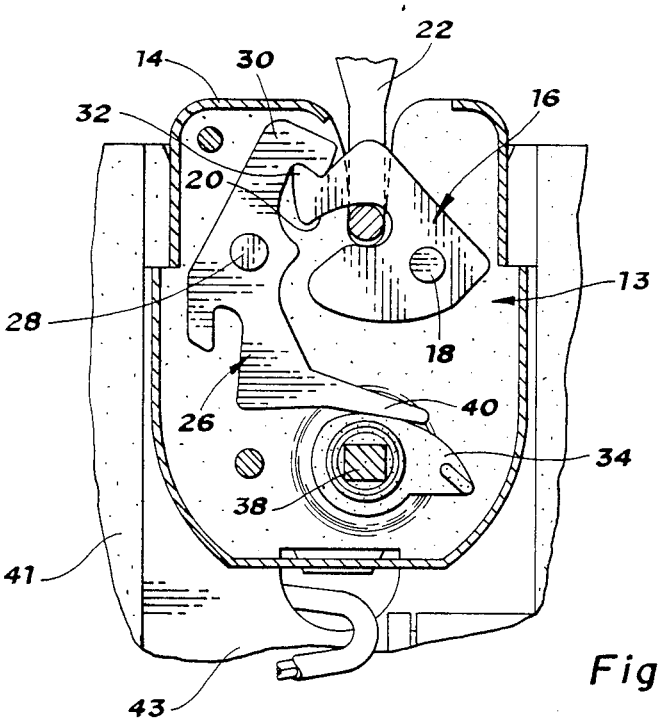
FIG. 3 is a section view taken in the direction of arrows 3—3 of FIG. 2.
Figure 5:
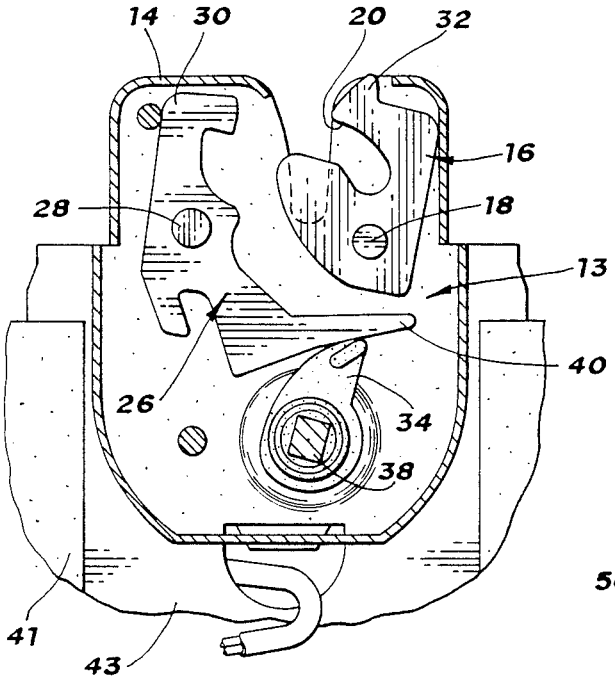
FIG. 5 is a view similar to FIG. 3 but showing the latch assembly having been extended so that the latch assembly is released by the cam lever.

The closure panel 10 may be latched in a closed position by a latch assembly generally indicated at 13 which is mounted on the vehicle body panel 11. The latch assembly 13, as best seen in FIGS. 3 and 5 includes a housing 14 having a latch bolt 16 mounted thereon by pivot 18. The latch bolt 16 has an opening 20 by which the latch bolt 16 is engageable with a striker 22 carried by the closure panel 10 to latch and interconnect the closure panel 10 with the body panel 11. The latch assembly 13 includes a spring, not shown, which biases the latch bolt 16 to the unlatched position shown in FIG. 5. The latch assembly 13 also includes a detent lever 26 mounted on housing 14 by pivot 28 and having a hook 30 which engages with a hook 32 of the latch bolt 16 to hold the latch bolt 16 in a latched position with respect to the striker 22 as shown in FIGS. 1 and 3. A spring urges detent lever 26 to the position of FIGS. 1 and 3.

The latch assembly 13 also includes a key operated lock cylinder, not shown which is rotatable when a properly fitted key is inserted. The key cylinder is connected to an actuator cam 34 by a bushing 36 and shaft 38. Upon rotation of the key cylinder, the actuator cam 34 is rotated and engages a cam follower portion 40 of the detent lever 26 to pivot the detent lever 26 about its pivot 28 to the position shown in FIG. 5, thereby disengaging the detent lever hook 30 from the latch bolt hook 32 so that the spring, not shown, returns the latch bolt 16 to its unlatched position of FIG. 5, to disconnect the latch assembly 13 from the striker 22 and enable the closure panel 10 to be moved to its open position by the closure panel spring.

Figure 2:
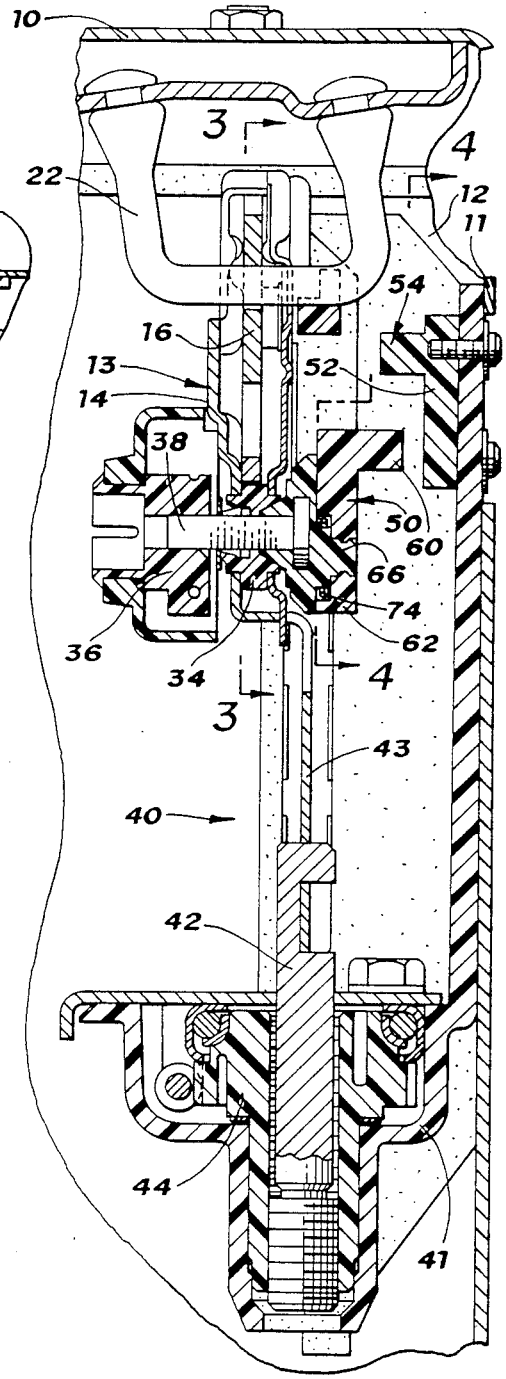
FIG. 2 is a side elevation view taken in the direction of arrows 2—2 of FIG. 1.
Figure 4:
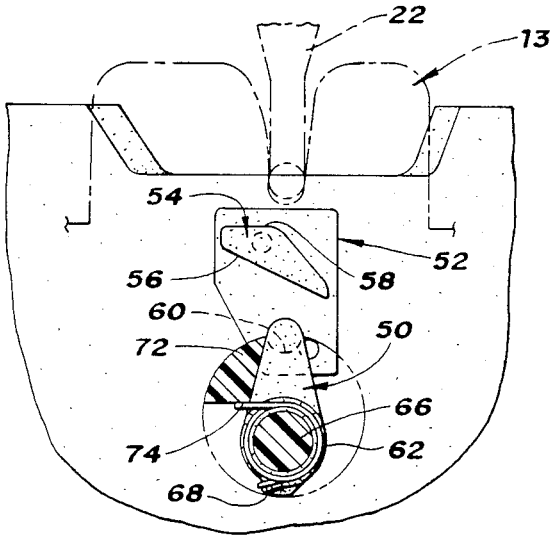
FIG. 4 is a section view taken in the direction of arrows 4—4 of FIG. 2.

Referring again to FIG. 1, a pull down mechanism, generally indicated at 40, is provided for moving the closure panel 10 from its partially closed position to the fully closed position of FIGS. 1, 2, 3 and 4. The pull down mechanism 40 includes housing 41 bolted to body panel 11 and having a guide track in which a mounting plate 43 slides up and down. The latch 13 is mounted on the mounting plate 43 and a jackscrew 42 is attached to the mounting plate 43. A reversible electric motor 45 is connected with the jackscrew by a suitable mechanism including a drive nut 44 which meshes with the jackscrew 42 to raise and lower the jackscrew 42 and the latch assembly 13 attached thereto upon energization of the motor. In the retracted position of FIG. 1, the panel 10 is pulled down to its fully closed position in which the closure panel 10 seats upon a weatherstrip carried by the body panel 11.

Reference may be made to U.S. Pat. No. 4,746,153 for a more complete description of the pull down unit 40 and the electrical circuit for operating the pull down unit.

Figure 7:
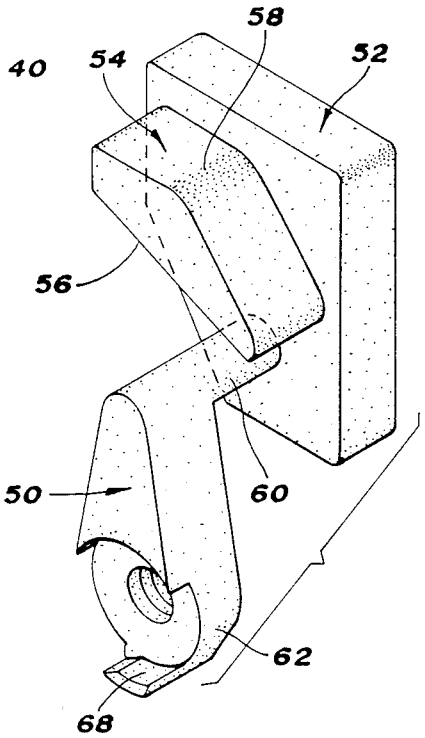
FIG. 7 is an enlarged perspective view showing the cam lever and the fixed cam; and FIGS. **8*a* through 8*h*** show the interaction between the cam lever and the fixed cam.

The present invention relates to a release mechanism provided to unlatch the latch assembly 13 from the striker 22 independently of the operation of the lock cylinder as discussed hereinbefore. The release mechanism, as best shown in FIGS. 2, 4 and 7, includes a cam lever 50 associated with the latch 13 and a cam block 52 which is mounted on the housing 41. As best seen in FIG. 7 the cam block 52 is of molded plastic and has a cam 54 projecting toward the cam lever 50. The cam 54 includes a lower cam surface 56 and an upper cam surface 58.

The cam lever 50 has cam follower 60 which projects into engagement with the cam 54 of cam block 52. The cam lever 50 includes a hub 62 which snaps on to a bushing 66 so that the cam lever is rotatable with respect to the hub 62. The bushing 66 is mounted on shaft 38 so that it rotates in unison with actuator cam 34 and bushing 36. A torsion spring 74 acts between an abutment 68 of the cam lever 50 and an abutment wall 72 of the bushing 66 to normally urge rotation of the cam lever 50 to the position of FIG. 4 in which the cam lever 50 grounds against the abutment wall 72 of the bushing 66. Accordingly, a counterclockwise rotation of the cam lever 50 from the position of FIG. 4 to the position of FIG. 6 will forcible rotate the hub 62 and actuator cam 34 to pivot the detent lever 26 of the latch assembly 13.

LATCH OPERATION

Figure 8A:
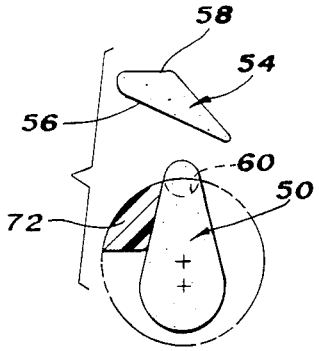

Referring to FIGS. 1 and 3 it is seen that the vehicle user has moved the closure panel 10 downwardly to carry the striker 22 into engagement with the latch bolt 16 of the latch assembly 13. The latch bolt 16 has been rotated to its latching position in which the striker 22 is captured in the slot 20 of the latch bolt 16. The hook 30 of the detent lever 26 has engaged with hook 32 of the latch bolt 16 to retain the latch bolt 16 at the latched position. Downward retracting movement of the latch 13 by the pull down unit 40 has pulled panel 10 downwardly to the fully closed position of FIG. 1. With the closure panel 10 fully closed as shown in FIG. 1, the leg 60 of cam lever 50 is poised beneath the cam 54 of cam block 52 as shown in FIGS. 2, 4 and 8*a*.

Figure 6:
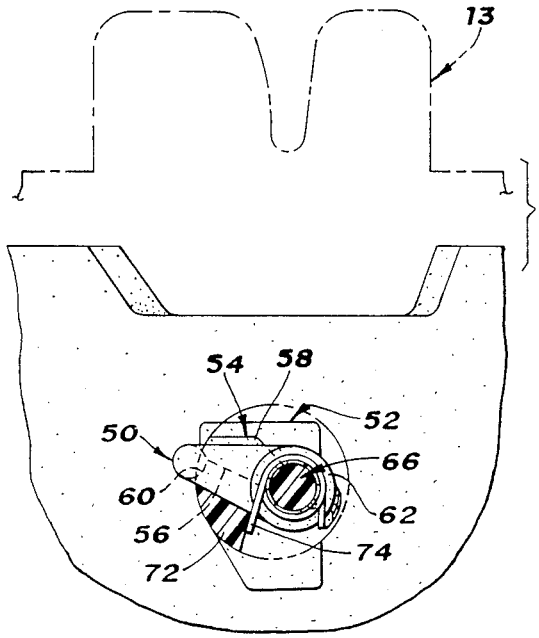
FIG. 6 is a view similar to FIG. 4 but showing the extending movement of the latch assembly causing the cam lever to engage the fixed cam and release the latch assembly.
Figure 8B:
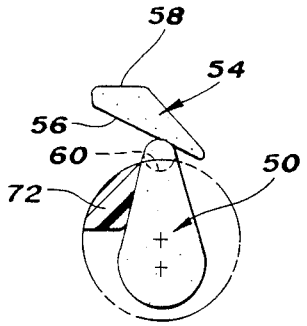
Figure 8C:
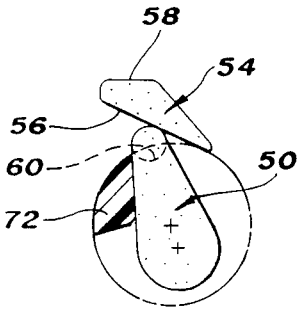
Figure 8D:
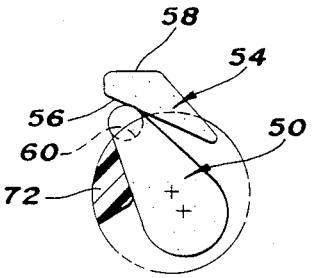
Figure 8E:
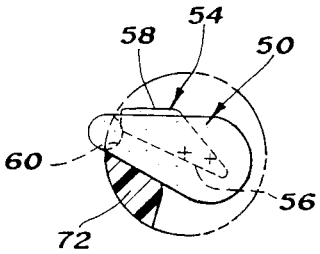
Figure 8F:
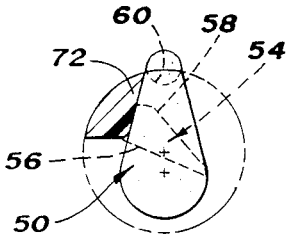

Referring to FIG. 2, it will be understood that unlatching of the striker 22 from the latch assembly 13 is initiated by actuating the motor of the pull down unit 40 to extend jackscrew 42 and latch 13 upwardly from the FIG. 1 solid line position to the phantom line indicated position The upward extending movement of the latch 13 raises the cam lever 50 so that the leg 60 thereof is carried into engagement with the lower surface 56 of cam 54 as shown in FIG. 8*b*. As the upward extending movement progresses, the cam lever 50 is progressively rotated in the counterclockwise direction as shown in FIG. 8*c*, 8*d* and 8*e*, so that the engagement of the cam lever 50 with the will 72 causes the bushing 66 to rotate and rotate the shaft 38 and actuator cam 34. This rotation of the actuator cam 34, as seen in FIGS. 5 and 6, rotates detent lever 26 away from engagement with fork bolt 16 so that the fork bolt 16 frees the striker, 22 from the latch assembly 13. When the latch assembly 13 reaches the fully extended position, the cam follower leg 60 will have proceeded around the end of the cam 54 to the position of FIG. 8*f*, permitting the cam lever 50 to have returned clockwise to the FIG. 3 position. Thus the cam follower 60 is poised above the cam 54 as shown in FIG. 8*f*.

Figure 8G:
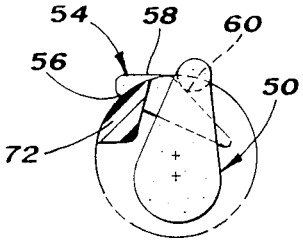
Figure 8H:
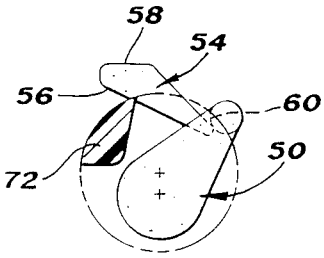

During subsequent closure of the closure panel 10, the latch assembly 13 is returned downwardly to its fully retracted position of FIGS. 1 and 2. During the downward movement of the latch assembly 13, the cam follower 60 engages the upper cam surface 58 and the cam lever 50 is rotated clockwise as seen in FIGS. 8*g* and 8*h*, as permitted by yielding of the spring 74 while the hub 66 remains stationary. With the latch assembly 13 in the fully retracted position of FIG. 4, the cam lever 50 is again poised beneath the cam 54 in readiness to release the latch upon a subsequent extending movement of the latch. Thus, the cam lever 50 is connected to the detent lever 26 via a lost motion connection acting between the cam lever 50 and the hub 66 so that the counterclockwise rotation of the cam lever 50 by engagement with the cam 54 is effective to rotate the detent lever 26 in the releasing direction upon movement toward the extending position, and yet the cam lever 50 rotates in the clockwise direction without rotating the actuator cam 34 as the cam lever 50 engages with the cam 54 during the retracting movement of the latch assembly.

Thus it is seen that the invention provides a new and novel closure panel pull down mechanism in which the cam lever associated with the latch assembly engages with a cam fixedly mounted on the vehicle body during extending movement of the latch assembly by a motorized drive unit to cam the detent lever to the position releasing the latch bolt thereby freeing the closure panel for movement to the open position. It will be appreciated that the release mechanism of this invention may be utilized in vehicles in which the striker is mounted on the body panel 11 and the motorized pull down unit and latch are mounted on the closure panel.

The embodiments of the invention in which an exclusive property or privilege is claimed are defined as follows:

1. In a vehicle body including a compartment panel spring-loaded for movement between open and closed positions with respect to a compartment defined by a body panel, a latch and pull down mechanism comprising:

a striker mounted on one of the panels;

a latch assembly having a latch bolt movable to an unlatched position and a detent lever for holding the latch bolt in the latched position for latching engagement with the striker;

a motorized pull down unit mounting the latch assembly on the other of the panels for movement between an extended position where the latch bolt of the latch assembly is engageable by the striker to latch the panels together upon partial closing movement of the closure panel, and a retracted position in which the closure panel is in the closed position;

remote opening means actuatable by a user for selectively operating the motorized pull down unit to move the latch assembly from the retracted position toward the extended position, and cam means acting in response to motorized movement of the latch assembly from its retracted position toward its extended position to cam the detent lever to a position releasing the detent lever from the latch bolt, said cam means including a cam follower lever mounted on the latch assembly and being operably associated with the detent lever, said cam follower lever projecting into engagement with a cam fixedly mounted on the other of the panels and being activated by the cam upon movement of the latch assembly from the retracted position to the extended position whereby the latch bolt is returned to the unlatched position thereby disconnecting the latch assembly from the striker and freeing the closure panel for spring-loaded movement of the open position.

2. The latch and pull down mechanism of claim 1 further characterized by said cam follower lever being connected to the detent lever by a lost motion connection by which the engagement of the cam follower lever with the cam is effective to rotate the detent lever in the releasing direction upon movement toward the extending position and by which the cam follower lever returns from said rotation in the releasing direction without rotating the detent lever as the cam follower lever engages with the cam during the retracting movement of the latch assembly.

* * * * *